US007862979B2

(12) United States Patent
Morris et al.

(10) Patent No.: US 7,862,979 B2
(45) **Date of Patent: *Jan. 4, 2011**

(54) TONER AND MANUFACTURING PROCESS THEREFOR

(75) Inventors: Daniel Patrick Morris, Manchester (GB); Martin Russell Edwards, Manchester (GB); Mohammed Nawaz, Manchester (GB); Oliver Callaghan, Manchester (GB); Simon Pickard, Cheadle (GB)

(73) Assignee: Fujifilm Imaging Colorants Limited, Manchester (GB)

( * ) Notice: Subject to any disclaimer, the term of this patent is extended or adjusted under 35 U.S.C. 154(b) by 118 days.

This patent is subject to a terminal disclaimer.

(21) Appl. No.: 12/084,577

(22) PCT Filed: Nov. 6, 2006

(86) PCT No.: PCT/GB2006/004143

§ 371 (c)(1),
(2), (4) Date: May 6, 2008

(87) PCT Pub. No.: WO2007/052063

PCT Pub. Date: May 10, 2007

(65) Prior Publication Data

US 2009/0269690 A1 Oct. 29, 2009

(30) Foreign Application Priority Data

Nov. 7, 2005 (GB) ..... 0522650.1

(51) Int. Cl.
*G03G 9/00* (2006.01)

(52) U.S. Cl. ..... 430/137.14; 430/108.1; 430/110.1; 430/137.1

(58) Field of Classification Search ..... 430/108.1, 430/110.1, 137.1, 137.14
See application file for complete search history.

(56) References Cited

U.S. PATENT DOCUMENTS

| | | | | |
|---|---|---|---|---|
| 4,983,488 | A | 1/1991 | Tan et al. | |
| 4,996,127 | A | 2/1991 | Hasegawa et al. | |
| 5,066,560 | A | 11/1991 | Tan et al. | |
| 5,418,108 | A | 5/1995 | Kmiecik-Lawrynowicz et al. | |
| 5,827,633 | A | 10/1998 | Ong et al. | 430/137 |
| 5,902,710 | A * | 5/1999 | Ong et al. | 430/108.1 |
| 6,137,977 | A * | 10/2000 | Okado et al. | 399/252 |
| 2002/0187415 | A1 | 12/2002 | Jiang et al. | 430/137.14 |
| 2002/0187416 | A1 * | 12/2002 | Jiang et al. | 430/137.14 |
| 2004/0152007 | A1 | 8/2004 | Combes et al. | 430/120 |
| 2005/0089785 | A1 * | 4/2005 | Chiba et al. | 430/106.1 |
| 2006/0204876 | A1 * | 9/2006 | Kaburagi et al. | 430/105 |
| 2009/0162774 | A1 * | 6/2009 | Morris et al. | 430/108.4 |

FOREIGN PATENT DOCUMENTS

| | | |
|---|---|---|
| EP | 0952493 | 10/1999 |
| WO | WO 98/50828 | 11/1998 |
| WO | WO 99/50714 | 10/1999 |
| WO | WO 2007/052062 | 5/2007 |

* cited by examiner

*Primary Examiner*—Hoa V Le
(74) *Attorney, Agent, or Firm*—Morgan Lewis & Bockius LLP

(57) ABSTRACT

The invention provides a process for the manufacture of a toner which comprises the steps of:

a) providing a latex dispersion containing primary resin particles and surfactant;
b) providing a colorant dispersion containing primary colorant particles and surfactant;
c) optionally providing a wax dispersion containing primary wax particles and surfactant;
d) providing at least one carboxy functional compound of Formula (1), which may be in acid, salt and/or complex form:

Formula (1)

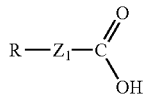

wherein R is a carbocyclic or heterocyclic radical which may be optionally substituted and $Z_1$ is a bond or linker group, on condition that the amount of carboxy functional compound of Formula (1) provided in acid and/or salt form is at least 1.5% by weight, wherein the amount of carboxy functional compound is calculated according to the following equation:

$$\text{amount of carboxy functional compound (\% weight)} = \frac{100 \times \text{weight of carboxy functional compound}}{\left(\begin{array}{c}\text{weight of carboxy functional compound} + \\ \text{weight of solids content of latex,} \\ \text{colorant and optional wax dispersions} + \\ \text{weight of any additional surfactant}\end{array}\right)}$$

e) mixing the latex dispersion, colorant dispersion, optional wax dispersion and said carboxy functional compound; and
f) causing the particles in the mixture to associate.

The process advantageously may produce a toner of small size and narrow particle size distribution. The present invention also provides a toner manufactured by the process.

18 Claims, No Drawings

TONER AND MANUFACTURING PROCESS THEREFOR

This invention relates to toners for use in the formation of electrostatic images and processes for their manufacture.

Dry toners for development of an electrostatic image comprise small colored resin particles typically less than 50 μm in size. The particle size distribution of the toner particles in a toner affects the quality of the final image. Ideally, a toner should be capable of forming an image with high resolution and high image density. Furthermore, the toner should preferably not suffer from problems such as filming which may be related, at least in part, to the particle size distribution.

Toners are conventionally produced by melt kneading of a pigment, resin and other toner ingredients, followed by milling or pulverisation to produce toner sized particles. Classification is then needed to generate an acceptably narrow particle size distribution of the toner particles.

More recently, attention has been focussed on chemical routes to toners, where a suitable particle size is not attained by a milling process, which thereby avoids the need for a classification step. By avoiding the classification step, less material is wasted and higher yields of toner can be attained, especially as the target particle size is reduced. Lower particle size toners are of considerable interest for a number of reasons, including better print resolution, lower pile height, greater yield from a toner cartridge, faster or lower temperature fusing, and lower paper curl.

Several chemical routes to toners have been exemplified in the prior art. These include suspension polymerisation, solution-dispersion processes and so-called aggregation processes. Several aggregation processes are known, for example, as described in U.S. Pat. Nos. 4,996,127, 5,418,108, 5,066,560 and 4,983,488, WO 98/50828 and WO 99/50714.

However, it is still desirable to provide further methods for making toners which are capable of reliably forming toner having a narrow particle size distribution.

According to one aspect of the present invention, there is provided a process for the manufacture of a toner which comprises the steps of:

a) providing a latex dispersion containing primary resin particles and surfactant;

b) providing a colorant dispersion containing primary colorant particles and surfactant;

c) optionally providing a wax dispersion containing primary wax particles and surfactant;

d) providing at least one carboxy functional compound of Formula (1), which may be in acid, salt and/or complex form Formula (1)

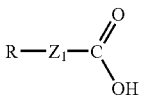

wherein R is a carbocyclic or heterocyclic radical which may be optionally substituted and $Z_1$ is a bond or linker group, on condition that the amount of carboxy functional compound of Formula (1) provided in acid and/or salt form is at least 1.5% by weight, wherein the amount of carboxy functional compound is calculated according to the following equation $$\text{amount of carboxy functional compound (\% weight)} = \frac{100 \times \text{weight of carboxy functional compound}}{\left(\begin{array}{c}\text{weight of carboxy functional compound} + \\ \text{weight of solids content of latex,} \\ \text{colorant and optional wax dispersions} + \\ \text{weight of any additional surfactant}\end{array}\right)}$$

e) mixing the latex dispersion, colorant dispersion, optional wax dispersion and said carboxy functional compound; and f) causing the particles in the mixture to associate.

The present invention, in another aspect, provides a toner manufactured by the process.

Advantageously, the process according to the present invention has been found to provide a manufacturing route to toners which is capable of producing toners of narrow particle size distribution. In particular, the proportion of fine particles and the proportion of coarse particles (grit) may be reduced compared to an aggregation process in which the carboxy functional compound of Formula (1) (hereinafter "the carboxy functional compound") is not employed in the manner according to the present invention.

At the same time as providing a narrow particle size distribution, the process according to the present invention may satisfy many other requirements for a desirable process. The process may provide a great deal of control over the toner shape and, generally, no further treatment may be required to alter the shape. In particular, a shape may be provided, as desired, from substantially spherical to substantially irregular.

The process may be very efficient at incorporating a wax in the toner in order to improve its release properties as well as incorporating other components such as a charge control agent (CCA). The wax may be incorporated in the toner in relatively large amounts compared with some prior art processes and may be incorporated in uniformly sized wax domains, which may improve the transparency of prints formed by the toner.

The process can produce a toner which may be capable of one or more of the following: fixing to a substrate at low temperatures by means of heated fusion rollers; releasing from the fusion rollers over a wide range of fusion temperatures and speeds, and over a wide range of toner print densities; possessing good storage stability, print transparency, toner charging characteristics and does not lead to background development of the photoconductor; not leading to filming of the metering blade or development roller (for a mono-component device) or the carrier bead (for a dual-component device), or of the photoconductor; having high transfer efficiency from the photoconductor to the substrate or intermediate transfer belt or roller and from the transfer belt or roller (where used) to the substrate; enabling efficient cleaning of any residual toner remaining after image transfer where a mechanical cleaning device is used.

The carboxy functional compound may be provided in acid (i.e. protonated) form, in salt form, in complex form (as herein defined below) or a mixture of two or more of these, on condition that the amount of carboxy functional compound in acid and/or salt form is at least 1.5% by weight. Accordingly, the Formulae shown herein for the carboxy functional compound (including in the claims) encompass the compound in acid, salt and/or complex form unless otherwise stated.

For the avoidance of doubt, the amount of the carboxy functional compound according to the equation above is an amount calculated as a percentage (% by weight) of the total weight of the carboxy functional compound in all forms (i.e. acid, salt and/or complex), the solids content of the latex, colorant and optional wax dispersions (which includes both non-surfactant solids and surfactant) and any additional surfactant (i.e. surfactant other than that present in the latex, colorant and optional wax dispersions).

In Formula (1), R is a carbocyclic or heterocyclic radical, each of which may be optionally substituted. The term carbocyclic radical herein means a radical wherein the atoms linked to form the carbocyclic ring are al carbon atoms. The term heterocyclic radical herein means a radical wherein the atoms linked to form the heterocyclic ring comprise one or more heteroatoms selected from S, O and N.

The carbocyclic radical may be an aliphatic or aromatic radical. Examples of aromatic radical include phenyl or naphthyl. Examples of aliphatic radical include cycloalkyl (e.g. cyclohexyl), cycloalkenyl (e.g. cyclohexenyl) and cycloalkynyl (e.g. cyclohexynyl).

The heterocyclic radical may be a heteroaromatic radical. Examples of heteroaromatic ring radical include pyridinyl, diazinyl, triazinyl or quinolinyl. Other examples of heterocyclic radical include piperidinyl.

Preferably, R is an optionally substituted carbocyclic aromatic radical. More preferably, R is optionally substituted phenyl or naphthyl (including 1-naphthyl and 2-naphthyl, preferably 2-naphthyl), so that the carboxy functional compound may be represented thus:

Formula (1a)

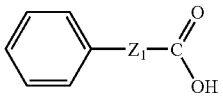

Formula (1b)

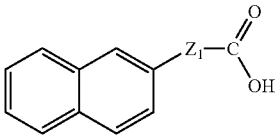

Formula (1c)

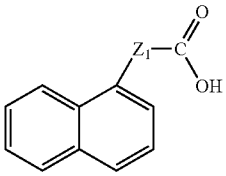

wherein the phenyl or naphthyl groups of Formulae (1a)-(1c) may optionally be substituted with further substituents. Preferably, the carboxy functional compound is of Formula (1a) or (1b).

$Z_1$ is a bond (i.e. where the carboxy group is attached directly to R) or linker group. $Z_1$ may be any known linker group. $Z_1$ may, for example, be one of: —O—; an optionally substituted $C_{1-20}$ (preferably $C_{1-4}$) alkyl linker, e.g. —$(CH_2)_x$—; an optionally substituted $C_{1-20}$ (preferably $C_{1-4}$) alkenyl linker; an optionally substituted $C_{1-20}$ (preferably $C_{1-4}$) alkoxy linker; or an optionally substituted $C_{1-20}$ (preferably $C_{1-4}$) polyether linker, e.g. —$(OCH_2)_x$— wherein x is an integer from 1 to 20 (preferably 1 to 4). Most preferably, $Z_1$ is a bond. Thus, the Formulae (1a)-(1c) are preferable of Formulae (1a')-(1c')

Formula (1a')

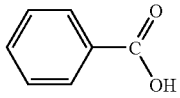

Formula (1b')

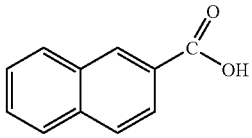

Formula (1c')

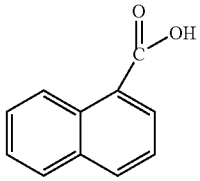

wherein the phenyl or naphthyl groups of Formulae (1a')-(1c') may optionally be substituted with further substituents.

The carboxy functional compound of Formula (1) may be provided as an acid (i.e. protonated form), as a salt, as a complex, or as a mixture of two or more of these on condition that the amount of carboxy functional compound in acid and/or salt form is at least 1.5% by weight. Without wishing to be bound by any theory, the acid and/or salt form of the carboxy functional compound is believed to be more effective (weight for weight) as an agent to reduce the particle size distribution of the final toner than the complex form. For instance, it has been found that the compound in acid form or salt form is effective in reducing the particle size distribution when employed in amounts as low as 1.5% by weight. It is more preferred still that the compound is provided in salt form in an amount which is at least 1.5% by weight. Preferably, the amount of carboxy functional compound provided in acid and/or salt form (especially salt form) is greater than 2.0% by weight, more preferably greater than 3.0% by weight In embodiments, the carboxy functional compound is substantially provided in salt form and optionally complex form.

The salt form may be a salt of a metal species or non-metal species (e.g. ammonium ion). Preferably, the salt is a salt of a metal species. The metal species with which the carboxy functional compound may form a metal salt may be any suitable metal species, including any metal, metal oxide, metal hydroxide or metal halide. Preferably, the salt is a salt of a meal. In particular, the metal may comprise a group IA metal (e.g. lithium, sodium or potassium) or group IIA metal (e.g. magnesium or calcium), preferably a group IA metal.

In the salt form of the carboxy functional compound of Formula (1), the carboxy group, or groups if more than one, is preferably present in an ionic form, i.e. —$CO_2^-M^+$wherein $M^+$ represents a metal ion or ammonium ion. Preferably $M^+$ is selected from $Li^+$, $Na^+$, $K^+$, $Mg^+$, $Ca^+$, and $NH_4^+$ (more preferably $Li^+$, $Na^+$, $K^+$, and $NH_4^+$). For the avoidance of doubt, the term salt herein excludes a complex as hereinafter defined. Typically, therefore, the salt has a ratio of carboxy functional compound:metal of 1:1 or less (e.g. 1:2, such as where there are two or more carboxy groups in the compound). More typically, the salt has a ratio of carboxy functional compound: metal of 1:1.

The term complex herein means a metal complex wherein the ratio of carboxy functional compound:metal is 2:1 or higher (e.g. 3:1), preferably 2:1. The metal of the complex may be a transition metal (e.g. titanium, vanadium, chromium, manganese, iron, cobalt, nickel, copper or zinc) or a group IIIB metal (e.g. aluminium or gallium). Preferred metal species with which the carboxy functional compound may form a metal complex are selected from aluminium, chromium, manganese, iron, cobalt, nickel, copper or zinc (especially aluminium and chromium).

Preferably, the carboxy functional compound of Formula (1) further carries at least one additional ionisable group (i.e. in addition to the carboxy group in Formula (1)). More preferably, the additional ionisable group may also be capable of forming a salt or of coordinating to a metal species with which the compound may form a complex. Preferred additional ionisable groups include another COOH, OH, $NH_2$ or SH and most preferred is OH. Preferably, the additional ionisable group is carried on R. In other words, preferably R carries both the $—Z_1—CO_2H$ group and the additional ionisable group (which is preferably OH). The additional ionisable group may be attached directly to R or via a linker group, which may be any known linker group including those examples of linker groups for $Z_1$ described above.

In view of the above preferences, a preferred carboxy functional compound is of Formula (2):

Formula (2)

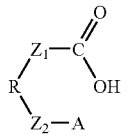

where $Z_2$ is a bond or linker group and A is an ionisable group.

$Z_2$ is a bond (i.e. where A is attached directly to R) or linker group. $Z_2$, may be any known linker group. $Z_2$ may, for example, be one of: —O—; an optionally substituted $C_{1-20}$ (preferably $C_{1-4}$) alkyl linker, e.g. $—(CH_2)_x—$; an optionally substituted $C_{1-20}$ (preferably $C_{1-4}$) alkenyl linker; an optionally substituted $C_{1-20}$ (preferably $C_{1-4}$) alkoxy linker; or an optionally substituted $C_{1-20}$ (preferably $C_{1-4}$) polyether linker, e.g. $—(OCH_2)_x—$ wherein x is an integer from 1 to 20 (preferably 1 to 4). Most preferably, $Z_2$ is a bond. Most preferably, both $Z_1$ and $Z_2$ are each a bond.

A is preferably an ionisable group selected from the group consisting of COOH, OH, $NH_2$ or SH and most preferably A is OH.

Most preferably, the $—Z_1—CO_2H$ and $—Z_2$-A groups are attached to R at adjacent ring positions. This positioning may facilitate coordination of the $CO_2H$ and A groups to the metal species with which the compound may form a complex. For instance, in the preferred embodiments where R is phenyl or naphthyl, preferably the carboxy functional compound has a Formula (3) or (4):

Formula (3)

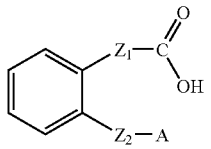

-continued

Formula (4)

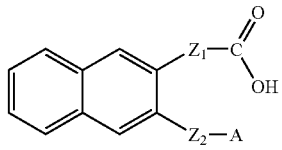

more preferably, a Formula (5) or (6):

Formula (5)

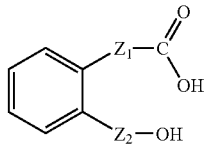

Formula (6)

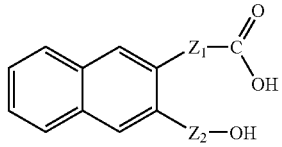

and most preferably, a Formula (7) or (8):

Formula (7)

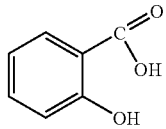

Formula (8)

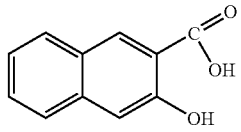

wherein in Formulae (3)-(8) the phenyl or naphthyl groups may optionally be substituted with further substituents.

The optional substituents for R (including for the phenyl and naphthyl groups of Formulae (1a)-(1c) and (3)-(8)), $Z_1$ and $Z_2$ are preferably selected from the following list: optionally substituted alkyl (especially optionally substituted $C_{1-4}$ alkyl), optionally substituted cycloalkyl, optionally substituted alkoxy (especially optionally substituted $C_{1-4}$ alkoxy), optionally substituted aryl, optionally substituted heteroaryl, optionally substituted aryloxy, optionally substituted amino, hydroxyl, halo, cyano, nitro, silyl, silyloxy, azo, sulpho (i.e. $SO_3H$), phosphato (i.e. $PO_3H_2$), $—COOR^1$, $—OCOOR^1$, $—OCOR^1$, $—COR^1$, $—CONR^1R^2$, $—OCONR^1R^2$, $—SR^1$, $—SO_2NR^1R^2$, or $—SO_2R^1$, wherein $R^1$ and $R^2$ each independently represent H, optionally substituted alkyl, optionally substituted cycloalkyl, or optionally substituted aryl. When any substituent group from the foregoing list is itself described as being optionally substituted, it may be substituted with any of the substituents from the same list. Groups such as sulpho, phosphato and carboxy (i.e. COOH) may be present in a salt form. It will be appreciated from the foregoing list that, in addition to the $—Z_1—CO_2H$ and $—Z_2$-A groups, R may be substituted still further by additional —$CO_2H$ or A groups. A preferred optional substituent for R is optionally substituted alkyl (especially $C_{1-4}$ alkyl), e.g. methyl, ethyl, propyl, isopropyl, n-butyl and tert-butyl. Preferably, any substituent on R does not comprise more than 6 carbon atoms and more preferably does not comprise more than 4 carbon atoms Preferred examples of the carboxy functional compound suitable for use in the present invention include the following (and their salts and complexes):

- salicylic acid;
- substituted salicylic acids;
- alkyl substituted salicylic acids (e.g. di-tertbutylsalicylic acid);
- naphthoic acid;
- substituted naphthoic acids;
- alkyl substituted naphthoic acids;
- hydroxy naphthoic acids, especially 2-hydroxy-3-naphthoic acids (e.g. "bon acid");
- substituted hydroxy naphthoic acids, especially substituted 2-hydroxy-3-naphthoic acids;
- alkyl substituted hydroxy naphthoic acids, especially alkyl substituted 2-hydroxy-3-naphthoic acids.

More preferred examples among these include optionally substituted salicylic acids, especially alkyl substituted salicylic acids (e.g. di-tertbutylsalicylic acid) and optionally substituted hydroxy naphthoic acids, especially optionally substituted 2-hydroxy-3-naphthoic acids (e.g. "bon acid"). In more preferred embodiments, the invention employs a salt and/or complex of these examples of carboxy functional compound. Commercial products include Bontron™ E81, E82, E84 and E88 (Orient Chem. Co.) and LR 147 (Japan Carlit).

There may be provided a mixture of two or more of the carboxy functional compounds. Preferred combinations of carboxy functional compounds include a mixture of an optionally substituted salicylic acid (e.g. di-tertbutylsalicylic acid) and an optionally substituted hydroxy naphthoic acid, especially an optionally substituted 2-hydroxy-3-naphthoic acid (e.g. bon acid), either or both of which may be provided in salt and/or complex form. More preferred combinations include a mixture of an optionally substituted salicylic acid in complex form and an optionally substituted hydroxy naphthoic acid in salt form.

As described above, the carboxy functional compound may be provided as the acid compound (i.e. protonated), as a salt of the compound, as a complex, or as a mixture of two or more of these on condition that the amount of carboxy functional compound in acid and/or salt form is at least 1.5% by weight. Preferably though, at least a portion of the carboxy functional compound is present in the form of a complex as herein defined. Preferably, a complex form of the carboxy functional compound is present in an amount of at least 1% by weight. For instance, a complex form of the carboxy functional compound may be present in an amount of 1 to 3% by weight Preferably, the total amount of carboxy functional compound (i.e. in all forms) provided is at least 2.5%, more preferably greater than 3% by weight. Preferably, the amount of carboxy functional compound (i.e. in all forms) provided is not more than 10%, more preferably not more than 7% and most preferably not more than 5%, by weight. Accordingly, a preferred range for the total amount of carboxy functional compound (i.e. in all forms) is 2.5 to 10%, a more preferred range is 2.5 to 7%, a still more preferred range is 2.5 to 5% and a most preferred range is 3 to 5% by weight.

All or at least a portion of the carboxy functional compound may be milled with the colorant, so as to form part of the colorant dispersion. Alternatively or additionally, at least a portion of the carboxy functional compound may be provided separately before mixing with the dispersions in the mixing step. Preferably, at least a portion, more preferably all, of the carboxy functional compound is provided separately. Where at least a portion of the carboxy functional compound is provided separately it may be provided, for example, as a wet-cake or solution. The wet-cake or solution may be a wet-cake or solution of the carboxy functional compound in salt or complex form. Where at least a portion of the carboxy functional compound is provided separately it is preferably provided as a wet cake. The solids content of the wet cake or solution is preferably at least 10% by weight. Where the carboxy functional compound is provided separately it is then mixed with the dispersions in the mixing step (e).

Preferably, additional surfactant (i.e. additional to the surfactant present as part of the latex, colorant and optional wax dispersions) is provided. Although preferable, the additional surfactant is, however, optional and not essential. The process preferably comprises mixing the additional surfactant with the latex dispersion, colorant dispersion, optional wax dispersion and carboxy functional compound in step (e). The additional surfactant may be provided with the carboxy functional compound (e.g. as part of a wet-cake) or provided separately. Preferably, the additional surfactant is an ionic surfactant, more preferably an ionic surfactant with a charge of the same sign as the surfactants used to stabilise the latex, colorant and optional wax dispersions and most preferably the same ionic surfactant as the surfactants used to stabilise the latex, colorant and optional wax dispersions. This is particularly preferable where a pH switch process is used to cause the particle association in step (f). The amount of the additional surfactant provided is preferably in the range 0.1 to 10% (more preferably 0.5 to 5%) by weight based on the total weight of the carboxy functional compound, the solids content of the latex, colorant and optional wax dispersions and surfactant (namely the additional surfactant).

The latex dispersion contains primary resin particles which are particles of the binder resin which goes to make up the bulk of the toner.

Preferably, the latex dispersion is a dispersion of the resin particles in water the latex dispersion preferably comprises an ionic surfactant to stabilise the resin particles in dispersion. Optionally, a non-ionic surfactant may also be incorporated into the latex dispersion.

In this invention, examples of anionic surfactants are:

Alkyl aryl sulphonates (e.g. sodium dodecylbenzenesulphonate)
Alkyl sulphates
Alkyl ether sulphates
Sulphosuccinates
Phosphate esters
Alkyl carboxylates
Alkyl ethoxylate carboxylates
Alkyl propoxylate carboxylates;
Examples of cationic surfactants are:
Quaternary ammonium salts
Benzalkonium chloride
Ethoxylated amines;
Examples of non-ionic surfactants are:
Alkyl ethoxylates
Alkyl propoxylates
Alkyl aryl ethoxylates
Alkyl aryl propoxylates
Ethylene oxide/propylene oxide copolymers.

In one preferred form of the process according to the present invention, the association in step (f) is caused by a pH switch process. Thus, the ionic surfactant present in the latex dispersion contains a group which can be converted from an ionic to a non-ionic form (and vice versa) by adjustment of pH. Preferred such groups include carboxylic acid or tertiary amine groups. Further preferably in that same preferred form of the process, the ionic surfactant on the latex dispersion has a charge (i.e. anionic or cationic) of the same sign as that of the ionic surfactant used in the colorant dispersion and optional wax dispersion described below. It is further preferred in such a case to use the same surfactant for each of the individual dispersions. This enables the association step (f) of the process to be performed by changing the pH in order to change the charge on the surfactant and thereby destabilise the dispersions and so cause association. Such a process is described fully in the applicant's earlier patent applications published as WO 98/50828 and WO 99/50714, the full contents of which are incorporated herein. In the foregoing preferred pH switch form of the process according to the present invention, the individual components can be particularly well mixed prior to inducing association, which, in turn, may lead to improved homogeneity of distribution of the components in the final toner. The pH switch embodiment furthermore may not require the addition of large quantities of salt or surfactant to induce association.

The latex dispersion may be prepared by polymerisation processes known in the art, preferably by emulsion polymerisation.

The molecular weight of the latex can be controlled by use of a chain transfer agent (e.g. a mercaptan), by control of initiator concentration and/or by heating time.

The latex dispersion may comprise a single latex or may comprise a combination of two or more separate latexes.

The latex(es) may be monomodal or bimodal in their molecular weight distribution. In one preferred embodiment, at least one latex with monomodal molecular weight distribution is combined with at least one latex with bimodal molecular weight distribution. By a latex with a monomodal molecular weight distribution is meant one in which the gpc spectrum shows only one peak. By a latex with a bimodal molecular weight distribution is meant one where the gpc spectrum shows two peaks, or a peak and a shoulder.

It is preferred that the overall molecular weight distribution of all the resin in the latex dispersion (i.e. the overall molecular weight distribution of the resin in the toner) shows Mw/Mn of 3 or more, more preferably 5 or more, most preferably 10 or more. The Tg of each resin is preferably from 30 to 100° C., more preferably from 45 to 75° C., most preferably from 50 to 70° C. If the Tg is too low, the storage stability of the toner will be reduced. If the Tg is too high, the melt viscosity of the resin will be raised, which will increase the fixation temperature and the temperature required to achieve adequate transparency. It is preferred that all the components in the resin have a substantially similar Tg.

The latex may comprise resin particles made from one or more of the following preferred monomers for emulsion polymerisation: styrene and substituted styrenes; acrylate and methacrylate alkyl esters (e.g. butyl acrylate, butyl methacrylate, methyl acrylate, methyl methacrylate, ethyl acrylate or methacrylate, octyl acrylate or methacrylate, dodecyl acrylate or methacrylate etc.); acrylate or methacrylate esters with polar functionality, for example hydroxy or carboxylic acid functionality, hydroxy functionality being preferred (particularly 2-hydroxyethyl acrylate, 2-hydroxyethyl methacrylate, or hydroxy-terminated poly(ethylene oxide) acrylates or methacrylates, or hydroxy-terminated poly(propylene oxide) acrylates or methacrylates), examples of monomers with carboxylic acid functionality including acrylic acid and beta-carboxyethylacrylate; vinyl type monomers such as ethylene, propylene, butylene, isoprene and butadiene; vinyl esters such as vinyl acetate; other monomers such as acrylonitrile, maleic anhydride, vinyl ethers. The resin may comprise a copolymer of two or more of the above monomers.

Preferred latexes comprise resin particles which are made from copolymers of (i) a styrene or substituted styrene, (ii) at least one alkyl acrylate or methacrylate and (iii) an hydroxy-functional acrylate or methacrylate.

The latex dispersion may comprise the following, not used in emulsion polymerisation: a dispersions of polyester, polyurethane, hydrocarbon polymer, silicone polymer, polyamide, epoxy resin and other resin known in the art.

The average size of the primary resin particles in the latex dispersion, as measured using photon correlation spectroscopy, is preferably less than 200 nm and more preferably less than 150 nm. The average size of the primary resin particles may, for example lie in the range 80-120 nm.

Preferably, the colorant dispersion is a dispersion in water. The colorant dispersion may be prepared by processes known in the art, preferably by milling the colorant with a surfactant in an aqueous medium.

Alternatively, an aqueous dispersion of colorant particles may be produced by a solution dispersion process in the following way. A polymer (e.g. polyester) is dissolved in an organic solvent. Preferably the solvent used should be immiscible with water, dissolve the polymer and/or be removable by distillation relatively easily. Suitable solvents comprise xylene, ethyl acetate and/or methylene chloride. To this solution is added a colorant, either a pigment or a dye. If a dye is used this is simply dissolved in the polymer solution to produce a colored liquid solution. If a pigment is used it may be added, preferably with one or more suitable pigment dispersants (which may be ionic or non-ionic). The colored polymer solution is then dispersed in water with a surfactant and the solvent removed by distillation to leave an aqueous dispersion of pigmentary particles containing the colorant dissolved or dispersed within the polymer.

The colorant dispersion preferably comprises an ionic surfactant to stabilise the colorant particles in dispersion. Optionally, a non-ionic surfactant may also be incorporated into the colorant dispersion. Examples of ionic and non-ionic surfactants for the colorant dispersion are the same as for the latex dispersion described above.

In one preferred embodiment of the process wherein the association is caused by a pH switch process, the colorant dispersion is stabilised with an ionic surfactant, which has the same sign as the ionic surfactant used for the latex dispersion and the optional wax dispersion and which is capable of being converted from an ionic to a non-ionic form (and vice versa) by a change in pH.

The colorant may be any color including black. The colorant contained in the colorant dispersion may comprise a pigment or a dye. Preferably, the colorant comprises a pigment. Any suitable pigment known in the art can be used, including black and magnetic pigments, for example carbon black, magnetite, copper phthalocyanine, quinacridones, xanthenes, mono- and dis-azo pigments, naphthols etc. Other examples include Cl Pigment Blue 15:3, Cl Pigment Red 31, 57, 81, 122, 146, 147, 184 or 185; Cl Pigment Yellow 12, 13, 17, 74, 155 180 or 185. In full colour printing it is normal to use yellow, magenta, cyan and black toners. However it is possible to make specific toners for spot colour or custom colour applications. The colorant is preferably present in an amount from 1-15% by weight based on the total weight of the carboxy functional compound, the solids content of the latex, colorant and optional wax dispersions (including surfactant therein) and any additional surfactant, more preferably from 1.5-10% by weight, most preferably from 2-8% by weight. These ranges are most applicable for organic, non-magnetic pigments. If, for example, magnetite was used as a magnetic filler/pigment, the level would typically be higher.

Preferably, in one embodiment of the process, the colorant dispersion is prepared by milling the colorant with an ionic surfactant, and optionally a non-ionic surfactant, until the particle size is suitably reduced.

Preferably, the volume average size of the primary colorant particle, which may be measured by a light scattering method, is less than 300 nm, more preferably less than 200 nm and most preferably less than 100 nm.

Preferably, a wax dispersion is used in the process. The wax dispersion is preferably a dispersion in water. The wax dispersion is preferably prepared by the mixing together of a wax with an ionic surfactant to stabilise the wax particles in dispersion. Examples of ionic and optionally non-ionic surfactants for the wax dispersion are the same as for the latex and colorant dispersions described above.

In one preferred embodiment of the process wherein the association is caused by a pH switch process, the wax dispersion is stabilised with an ionic surfactant, which has the same sign as the ionic surfactant used for the latex dispersion and the colorant dispersion and which is capable of being converted from an ionic to a non-ionic form (and vice versa) by a change in pH.

The wax should have a melting point (mpt) (as measured by the peak position by differential scanning calorimetry (dsc)) of from 50 to 150° C., preferably from 50 to 130° C., more preferably from 50 to 110° C., especially from 65 to 85° C. If the mpt is >150° C. the release properties at lower temperatures are inferior, especially where high print densities are used. If the mpt is <50° C. the storage stability of the toner will suffer, and the toner may be more prone to showing filming of the OPC or metering blade.

The wax may comprise any conventionally used wax. Examples include hydrocarbon waxes (e.g. polyethylenes such as Polywax™ 400, 500, 600, 655, 725, 850, 1000, 2000 and 3000 from Baker Petrolite; paraffin waxes and waxes made from CO and $H_2$, especially Fischer-Tropsch waxes such as Paraflint™ C80 and H1 from Sasol; ester waxes, including natural waxes such as Carnauba and Montan waxes; amide waxes; and mixtures of these. Hydrocarbon waxes are preferred, especially Fischer-Tropsch, paraffin and polyethylene waxes. It is especially preferred to use a mixture of Fischer-Tropsch and Carnauba waxes, or a mixture of paraffin and Carnauba waxes.

The amount of wax used in the process is preferably from 1 to 30% by weight based on the total weight of the carboxy functional compound, the solids content of the latex, colorant and wax dispersions and surfactant, more preferably from 3 to 20% by weight, especially from 5 to 15% by weight. If the level of wax is too low, the release properties may be inadequate for oil-less fusion. Too high a level of wax will reduce storage stability and lead to filming problems. The distribution of the wax through the toner is also an important factor, it being preferred that wax is substantially not present at the surface of the toner.

The volume average particle size of the primary wax particles, which may be measured by a light scattering method, in the dispersion is preferably in the range from 100 nm to 2 μm, more preferably from 100 to 800 nm, still more preferably from 150 to 600 nm, and especially from 200 to 500 nm. The wax particle size is chosen such that an even and consistent incorporation into the toner is achieved.

Within the scope of the invention and claims, in embodiments, the latex dispersion, colorant dispersion and optional wax dispersion are separate dispersions which are then mixed (in step(e)). However, in certain embodiments, the primary resin particles may be prepared in a dispersion along with either or both of the primary colorant and/or wax particles, such that the latex, colorant and/or wax dispersions may be one and the same. It is also possible that the primary colorant and wax particles are prepared in one dispersion so that the colorant and wax dispersions are one and the same.

The process of the present invention may further comprise providing a charge control agent (CCA) which may be selected from such known classes of CCAs as metal azo complexes, phenolic polymers and calixarenes, nigrosine, quaternary ammonium salts, and arylsulphones. Preferred CCAs are colourless.

The CCA may be provided as a component of one of the dispersion in steps (a)-(c) or the CCA may be provided separately and added as part of the pre-association mixture, preferably as a solution or wet cake. Additionally or alternatively, a CCA may be added externally to the toner prepared by the process, in which case a suitable high-speed blender may be used, e.g. a Nara Hybridiser or Henschel blender. Where the CCA is added externally it is preferably added to the dried toner.

Preferably, each dispersion is a dispersion in water.

Mixing of the dispersions in step (e) may be performed by any conventional method of mixing dispersions. The mixing may include a low shear condition (e.g. using a low shear stirring means) and/or a high shear condition (e.g. using a rotor-stator type mixer). The mixed dispersions may be heated at a temperature below the Tg prior to association.

The particles in the mixture obtained in step (e) may be caused to associate in step (f) by any suitable method known in the art. For instance, the association may be caused by heating and stirring as described, for example, in U.S. Pat. No. 4,996,127 (Nippon Carbide), by the addition of an inorganic salt as described, for example, in U.S. Pat. No. 4,983,488 (Hitachi Chemical Co.) or by the action of organic coagulants, including counterionic surfactants as described, for example, in U.S. Pat. No. 5,418,108 and numerous other patents of Xerox.

In a preferred method, the association is caused by a pH switch, i.e. by effecting a change in the pH, preferably either from a basic pH to an acidic pH or from an acidic pH to a basic pH. Such association processes are described in WO 98/50828 and WO 99/50714. In this case, surfactant present in each of the dispersions is reversibly ionisable or de-ionisable, i.e. contains a group which can be converted from an ionic to a non-ionic form and vice versa by adjustment of pH. In a particularly preferred example, the surfactant may contain a carboxylic acid group, and the dispersions may be mixed at neutral to high (i.e. above neutral) pH with association then being effected by addition of an acid, which decreases the pH and converts the surfactant from its dispersion stabilising anionic form to its non-stabilising non-ionic form. Alternatively, in another preferred example, the surfactant may contain a group which is the acid salt of a tertiary amine, and the dispersions may be mixed at neutral to low (i.e. below neutral) pH with association then being effected by addition of a base which increases the pH and converts the surfactant from its dispersion stabilising cationic form to ts non-stabilising non-ionic form. The pH switch processes allow a very efficient use of surfactant and have the ability to keep overall surfactant levels very low. This is advantageous since residual surfactant in the final toner can be problematic, especially in affecting the charging properties of the toner, particularly at high humidity. In addition, such processes avoid the need for large quantities of salt, as required for some prior art processes, which would need to be washed out.

Stirring and mixing are preferably performed during the association step.

The association step is preferably carried out below the Tg of the resin in the latex.

After the association step (f), the process preferably comprises a further step (g) of heating and/or stirring the associated mixture (preferably at a temperature below the Tg of the resin particles). Preferably such heating and/or stirring of the associated mixture causes loose aggregates to form. The aggregates are composite particles comprising the primary particles of resin, colorant and optionally wax. Preferably, the aggregates are of particle size from 1 to 20 μm, more preferably from 2 to 20 μm. Once the desired aggregate particle size is established, the aggregates may be stabilised against further growth. This may be achieved, for example, by addition of further surfactant, and/or by a change in pH where a pH switch process was employed for the association as is known in the art (e.g. WO 98/50828).

After the association step (f) and optional further step (g) of heating and/or stirring to establish the desired particle size, the temperature may then be raised above the T of the resin in a step (h) to form toner particles. The step (h) brings about coalescence of the particles, e.g. within each aggregate and/or between aggregates, to form toner particles. The toner particles typically have a volume average particle size from 2 to 20 μm, more preferably 4 to 10 μm, still more preferably 5 to 9 μm and most preferably 6 to 8 μm. During this step of heating above the Tg the shape of the toner may be controlled through selection of the temperature and the heating time.

The dispersion of toner particles may then be cooled and the toner particles recovered, e.g. by filtration, for subsequent use as an electrophotographic toner. The toner may then optionally be washed (e.g. to remove at least some surfactant) and/or optionally be dried using methods known in the art. The washing step, for example, may comprise washing with water, or dilute acid or base. The washing step typically removes at least some (preferably most) of the portion of the carboxy functional compound which is present in a protonated form or in the form of a salt. Thus, carboxy functional compound in protonated form or in the form of a salt (i.e. not in the form of a metal complex) may be utilised in the process to assist formation of a toner having narrow particle size distribution whilst substantially not remaining in the final toner after a washing step.

The toner particles, especially the recovered and dried toner particles, may be blended with one or more surface additives to improve the powder flow properties of the toner, or to tune the tribocharge properties, as is known in the art. Typical surface additives include, but are not limited to, silica, metal oxides such as titania and alumina, polymeric beads (for example acrylic or fluoropolymer beads) and metal stearates (for example zinc stearate). Conducting additive particles may also be used, including those based on tin oxide (e.g. those containing antimony tin oxide or indium tin oxide).

Each surface additive may be used at 0.1-5.0 wt % based on the weight of the unblended toner (i.e. the toner prior to addition of the surface additive), preferably 0.2-3.0 wt %, more preferably 0.25-2.0 wt %. The total level of surface additives used may be from about 0.1 to about 10 wt %, preferably from about 0.5 to 5%, based on the weight of the unblended toner.

The additives may be added by blending with the toner, using, for example, a Henschel blender, a Nara Hybridiser, or a Cyclomix blender (Hosokawa).

The particles of the above surface additives, including silica, titania and alumina, may be made hydrophobic, e.g. by reaction with a silane and/or a silicone polymer. Examples of hydrophobising groups include alkyl halosilanes, aryl halosilanes, alkyl alkoxysilanes (e.g. butyl trimethoxysilane, isobutyl trimethoxysilane and octyl trimethoxysilane), aryl alkoxysilanes, hexamethyldisilazane, dimethylpolysiloxane and octamethylcyclotetrasiloxane. Other hydrophobising groups include those containing amine or ammonium groups. Mixtures of hydrophobising groups can be used (for example mixtures of silicone and silane groups, or alkylsilanes and aminoalkylsilanes.)

Examples of hydrophobic silicas include those commercially available from Nippon Aerosil, Degussa, Wacker-Chemie and Cabot Corporation. Specific examples include those made by reaction with dimethyldichlorosilane (e.g. Aerosil™ R972, R974 and R976 from Degussa); those made by reaction with dimethylpolysiloxane (e.g. Aerosil™ RY50, NY50, RY200, RY200S and R202 from Degussa); those made by reaction with hexamethyldisilazane (e.g. Aerosil™ RY50, NAX50, RY200, RY300, R812 and R812S from Degussa); those made by reaction with alkylsilanes (e.g. Aerosil™ R805 and R816 from Degussa) and those made by reaction with octamethylcyclotetrasiloxane (e.g. Aerosil™ R104 and R106 from Degussa).

The primary particle size of suitable surface additives, especially silicas, is typically from 5 to 200 nm, preferably from 7 to 50 nm. The BET surface area of the additives, especially silicas, may be from 10 to 350 $m^2/g$, preferably 30-300 $m^2/g$. Combinations of additives, especially silicas, with different particle size and/or surface area may be used.

It is possible to blend the different size additives in a single blending step, but it is often preferred to blend them in separate blending steps. In this case, the larger additive may be blended before or after the smaller additive. It may further be preferred to use two stages of blending, where in at least one stage a mixture of additives of different particle size is used. For example, an additive with low particle size may be used in the first stage, with a mixture of additives of different particle size in the second step.

Where titania is used, it is preferred to use a grade which has been hydrophobised, e.g. by reaction with an alkylsilane and/or a silicone polymer. The titania may be crystalline or amorphous. Where crystalline it may consist of rutile or anatase structures, or mixtures of the two. Examples include grades T805 or NKT90 from Nippon Aerosil and STT-30A from Titan Kogyo.

Hydrophilic or hydrophobic grades of alumina may be used. An example is Aluminium Oxide C from Degussa.

It is often preferred to use combinations of silica and titania, or of silica, titania and alumina. Combinations of large and small silicas, as described above, can be used in conjunction with titania, alumina, or with blends of titania and alumina. It is also often preferred to use silica alone. In that case, combinations of large and small silicas, as described above, can be used.

Preferred formulations of surface additives include those in the following list:

- hydrophobised silica;
- large and small particle size silica combinations, which silicas may be optionally hydrophobised;
- hydrophobised silica and one or both of hydrophobised titania and hydrophilic or hydrophobised alumina;

large and small particle size silica combinations as described above; and one or both of hydrophobised titania and hydrophilic or hydrophobised alumina.

Polymer beads or zinc stearate may be used to improve the transfer efficiency or cleaning efficiency of the toners. Charge control agents (CCAs) may be added in the external formulation (i.e. surface additive formulation) to modify the charge level or charging rate of the toners.

The process according to the present invention is especially suitable for producing a toner of narrow particle size distribution.

According to a further aspect of the present invention there is provided a toner obtainable by the process of the present invention wherein the volume average particle size of the toner is in the range from 2 to 20 μm and the $GSD_n$ value is not greater than 1.30.

The volume average particle size of the toner is preferably in the range from 4 to 10 μm, more preferably 5 to 9 μm, and most preferably in the range from 6 to 8 μm. The volume average particle size and the particle size distribution as defined hereinafter ($GSD_n$ and $GSD_v$) refer to sizes as measured using a Coulter™ counter with a 100 μm aperture. Although it will be appreciated that other methods of preparing the toner for obtaining the Coulter™ counter measurement can be used, for example as described in U.S. Pat. No. 4,985,327, the Coulter™ counter measurement may be conveniently obtained in the present invention by analysing the dispersion of toner particles produced after the coalescence step of the process.

The $GSD_n$ value is defined by the following expression:

$$GSD_n = D_{50}/D_{15.9}$$

wherein $D_{50}$ is the particle size below which 50% by number of the toner particles have their size and $D_{15.9}$ is the particle size below which 15.9% by number of the toner particles have their size.

Preferably, the $GSD_n$ value is not greater than 1.28 and more preferably not greater than 1.25.

A $GSD_v$ value is defined by the following expression:

$$GSD_v = D_{84.1}/D_{50}$$

wherein $D_{84.1}$ is the particle size below which 84.1% by volume of the toner particles have their size and $D_{50}$ is the particle size below which 50% by volume of the toner particles have their size.

Preferably the $GSD_v$ value is not greater than 1.30, more preferably not greater than 1.25, still more, preferably not greater than 1.23 and most preferably not greater than 1.20.

The $GSD_n$ and $GSD_v$ values of the toner of the present invention are calculated from the particle size distribution obtained by a Coulter™ Counter using a 100 μm aperture as described above. For example, a Coulter™ Multisizer II instrument may be used.

The low $GSD_n$ and $GSD_v$ of the toner according to the present invention provides, among other things, that the toner may possess a more uniform charge distribution leading to improved image quality and have a lower tendency toward filming.

The toner according to the present invention preferably has a mean circularity, as hereinafter defined, of the toner particles as measured by a Flow Particle Image Analyser of at least 0.90, more preferably of at least 0.93.

Further preferably, the shape factor of the toner particles, SF1, as hereinafter defined, is at most 165, more preferably at most 155.

Additionally preferably, the shape factor of the toner particles, SF2, as hereinafter defined, is at most 155, more preferably at most 145.

The smoothness of the toner after the coalescence stage may also be assessed by measuring the surface area of the toner, for example by the BET method. It is preferred that the BET surface area of the unblended toner is in the range 0.5-1.5 $m^2/g$.

Toner having the above shape properties has been found to have high transfer efficiency from the photoconductor to a substrate (or to an intermediate transfer belt or roller), in some cases close to 100% transfer efficiency.

The shape of the toner may be measured by use of a Flow Particle Image Analyser (Sysmex FPIA) and by image analysis of images generated by scanning electron microscopy (SEM).

The circularity is defined as the ratio:

$$Lo/L$$

where Lo is the circumference of a circle of equivalent area to the particle, and L is the perimeter of the particle itself.

The shape factor, SF1, is defined as:

$SF1=(ML)^2/A\times\pi/4\times100$, where ML=maximum length across toner, A=projected area The shape factor, SF2, is defined as:

$SF2=P^2/A\times1/4\pi\times100$, where P=the perimeter of the toner particle, A=projected area An average of approximately 100 particles is taken to define the shape factors (SF1 and SF2) for the toner.

If the toner is designed for a printer or copier which does not employ a mechanical cleaning device, it may be preferred to coalesce the toner until a substantially spherical shape is attained, e.g. wherein the mean circularity is at least 0.98. If, however, the toner is designed for use in a printer or copier in which a mechanical cleaning device is employed to remove residual toner from the photoconductor after image transfer, it may be preferred to select a smooth but off-spherical shape, where the mean circularity is in the range 0.90-0.99, preferably 0.93-0.98, more preferably 0.94-0.98 and still more preferably 0.94-0.96, where SF1 is 105-165, preferably 105-155, more preferably 105-150 and still more preferably 105-145 and where SF2 is 105-155, preferably 105-145, more preferably 105-140 and still more preferably 105-135. In the smooth but off-spherical shape, the SF1 is particularly preferably 130-150 and most particularly preferred of all 135-145 and SF2 is particularly preferably 120-140, and most particularly preferred of all 125-135.

Where a wax is used in the process to obtain the toner, the wax is preferably present in the toner in domains of mean diameter 2 μm or less, preferably 1.5 μm or less. Preferably, the wax domains are of mean diameter 0.5 μm or greater. If the mean size of the wax domains is >2 μm, the transparency of the printed film may be reduced, and the storage stability may decrease. The domain size values are preferably those measured by analysing sections of the toner by transmission electron microscopy. Preferably the wax is not substantially present at the surface of the toner.

The toner may be used as a mono-component or a dual component developer. In the latter case the toner is mixed with a suitable carrier bead.

Advantageously, the toner may be capable of fixing to the substrate at low temperatures by means of heated fusion rollers where no release oil is applied and may be capable of releasing from the fusion rollers over a wide range of fusion temperatures and speeds, and over a wide range of toner print densities. Furthermore, preferably, the toner according to the invention does not lead to background development of the photoconductor (OPC) and preferably does not lead to filming of the metering blade or development roller (for a monocomponent device) or the carrier bead (for a dual-component device), or of the photoconductor.

Preferably, the haze values of prints using the toner of the invention do not vary considerably with fusion temperature. Haze may be assessed using a spectrophotometer, for example a Minolta CM-3600d, following ASTM D 1003. Preferably, the haze at a print density of 1.0 mg/cm$^2$ is below 40, preferably below 30, and the ratio of the values at fusion temperatures of 130 and 160° C. is preferably at most 1.5, more preferably 1.3 and most preferably 1.2.

The invention may be particularly suitable for use in an electroreprographic apparatus or method where one or more of the following hardware conditions of an electroreprographic device applies:

i) where the device contains a developer roller and metering blade (i.e. where the toner is a monocomponent toner);

ii) where the device contains a cleaning device for mechanically removing waste toner from the photoconductor;

iii) where the photoconductor is charged by a contact charging means;

iv) where contact development takes place or a contact development member is present;

v) where oil-less fusion rollers are used;

vi) where the above devices are four colour printers or copiers, including tandem machines Preferably, the invention provides a toner which satisfies many requirements simultaneously. The toner may be particularly advantageous for use in a mono-component electroreprographic apparatus and may be capable of demonstrating: formation of high resolution images; release from oil-less fusion rollers over a wide range of fusion temperature and print density; high transparency for OHP slides over a wide range of fusion temperature and print density; high transfer efficiency and the ability to clean any residual toner from the photoconductor, and the absence of filming of the metering blade, development roller and photoconductor over a long print run.

Throughout the description and claims of this specification, the words "comprise" and "contain" and variations of the words, for example "comprising" and "comprises", mean "including but not limited to", and are not intended to (and do not) exclude other components and/or steps.

Unless the context clearly indicates otherwise, plural forms of the terms herein are to be construed as including the singular form and vice versa.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

It will be appreciated that many of the features described above, particularly of the preferred embodiments, are inventive in their own right and not just as part of an embodiment of the present invention. Independent protection may be sought for these features in addition to or alternative to any invention presently claimed.

The invention will now be illustrated by the following Examples, which are non-limiting on the scope of the invention. All percentages or parts referred to are percentages or parts by weight unless otherwise stated. The solids contents quoted for the dispersions in these examples includes any surfactant present.

EXAMPLE 1

Preparation of Latexes

EXAMPLE 1.1

Synthesis of Low Molecular-weight Latex (a-1)

A low molecular weight resin was synthesised by emulsion polymerisation. The monomers used were styrene (83.2 wt % of total monomers), 2-hydroxyethyl methacrylate (3.5 wt %) and acrylic ester monomers (13.3 wt %). Ammonium persulphate (0.5 wt % on monomers) was used as the initiator, and a mixture of thiol chain transfer agents (4.5 wt % on monomers) was used as chain transfer agents. The surfactant was Akypo™ RLM100 (a carboxylated alkyl ethoxylate, i.e. a carboxy-functional surfactant, available from Kao, 3.0 wt % on monomers). The emulsion had a particle size of 77 nm, and a Tg midpoint (as measured by differential scanning calorimetry (dsc)) of 59° C. GPC analysis against polystyrene standards showed the resin to have Mn=6,300, Mw 14,400, Mw/Mn=2.29. The solids content of the latex dispersion (a-1) was 30 wt %.

EXAMPLE 1.2

Synthesis of Low Molecular-weight Latex (a-2)

A low molecular weight resin was synthesised by emulsion polymerisation. The monomers used were styrene (83.2 wt %), 2-hydroxyethyl methacrylate (3.5 wt %) and acrylic ester monomers (13.3 wt %). Ammonium persulphate (0.5 wt % on monomers) was used as the initiator, and a mixture of thiol chain transfer agents (4.5 wt % on monomers) was used as chain transfer agents. The surfactant was Akypo™ RLM100 (3.0 wt % on monomers). The emulsion had a particle size of 89 nm, and a Tg midpoint (as measured by differential scanning calorimetry (dsc)) of 57° C. GPC analysis against polystyrene standards showed the resin to have Mn=6,200, Mw=14,800, Mw/Mn=2.39. The solids content of the latex dispersion (a-2) was 30.6 wt %.

EXAMPLE 1.3

Synthesis of Medium Molecular-weight Latex (a-3)

A bimodal molecular weight distribution latex was made by a two-stage polymerisation process, in which the higher molecular weight portion was made in the absence of chain transfer agent, and in which the molecular weight of the lower molecular weight portion was reduced by use of 2.5 wt % of mixed thiol chain transfer agents. Ammonium persulphate (0.5 wt % on monomers) was used as the initiator, and the surfactant was Akypo™ RLM100 (3.0 wt % on monomers).

The monomer composition of the low molecular weight portion was styrene (82.5%), 2-hydroxyethyl methacrylate (2.5%) and acrylic ester monomers (15.0%). The overall monomer composition was styrene (73.85 wt %), 2-hydroxyethyl methacrylate (6.25 wt %) and acrylic ester monomers (19.9 wt %). The emulsion had a particle size of 81 nm. GPC analysis against polystyrene standards showed the resin to have Mn=33,000, Mw=704,000, Mw/Mn=21.3. The solids content of the latex dispersion (a-3) was 39.9 wt %.

EXAMPLE 1.4

Synthesis of Medium Molecular-weight Latex (a-4)

A bimodal molecular weight distribution latex was made by a two-stage polymerisation process, in which the higher molecular weight portion was made in the absence of chain transfer agent, and in which the molecular weight of the lower molecular weight portion was reduced by use of 2.5 wt % of mixed thiol chain transfer agents. Ammonium persulphate (0.5 wt % on monomers) was used as the initiator, and the surfactant was Akypo™ RLM100 (3.0 wt % on monomers). The monomer composition of the low molecular weight portion was styrene (82.5%), 2-hydroxyethyl methacrylate (2.5%) and acrylic ester monomers (15.0%). The overall monomer composition was styrene (73.85 wt %), 2-hydroxyethyl methacrylate (6.25 wt %) and acrylic ester monomers (19.9 wt %). The emulsion had a particle size of 82 nm. GPC analysis against polystyrene standards showed the resin to have Mn=20,000, Mw=679,000, Mw/Mn=34.0. The solids content of the latex dispersion (a-4) was 40 wt %.

EXAMPLE 1.5

Synthesis of Medium Molecular-weight Latex (a-5)

A bimodal molecular weight distribution latex was made by a two-stage polymerisation process, in which the higher molecular weight portion was made in the absence of chain transfer agent, and in which the molecular weight of the lower molecular weight portion was reduced by use of 2.5 wt % of mixed thiol chain transfer agents. Ammonium persulphate (0.5 wt % on monomers) was used as the initiator, and the surfactant was Akypo™ RLM100 (3.0 wt % on monomers). The monomer composition of the low molecular weight portion was styrene (82.5%), 2-hydroxyethyl methacrylate (2.5%) and acrylic ester monomers (15.0%). The overall monomer composition was styrene (73.85 wt %), 2-hydroxyethyl methacrylate (6.25 wt %) and acrylic ester monomers (19.9 wt %). The emulsion had a particle size of 88 nm. GPC analysis against polystyrene standards showed the resin to have Mn=15,700, Mw=1,213,000, Mw/Mn=77.3. The solids content of the latex dispersion (a-4) was 40 wt %.

EXAMPLE 2

Pigment Dispersions

EXAMPLE 2.1

Magenta Pigment Dispersion (b-1)

A dispersion of Cl Pigment Red 122 was used. The pigment was milled in water using a bead mill, with Akypo™ RLM100 and Solsperse™ 27000 (Noveon) as dispersants. The solids content of the dispersion was 28.6 wt %.

EXAMPLE 2.2

Cyan Pigment Dispersion (b-2)

A dispersion of Cl Pigment Blue 15:3 was used. The pigment was milled in water using a bead mill, with Akypo™ RLM100 and Solsperse™ 27000 as dispersants. The solids content of the dispersion was 27.3 wt %.

EXAMPLE 2.3

Magenta Pigment Dispersion (b-3)

A dispersion of Cl Pigment Red 122 was used. The pigment was milled in water using a bead mill, with Akypo™ RLM100 and Solsperse™ 27000 as dispersants. The total solids of the dispersion was 28.8 wt %.

EXAMPLE 3

Wax Dispersions

EXAMPLE 3.1

Wax Dispersion (c-1)

A wax mixture comprising 80 parts by weight Paraflint C80 and 20 parts carnauba wax was melt dispersed in water, with Akypo™ RLM100. The solids content of the dispersion was 25.4%.

EXAMPLE 3.2

Wax Dispersion (c-2)

A wax mixture comprising 80 parts by weight Paraflint C80 and 20 parts carnauba wax was melt dispersed in water, with Akypo™ RLM100 (Kao). The total solids was 25.25%.

EXAMPLE 3.3

Wax Dispersion (c-3)

A wax mixture comprising 80 parts by weight Paraflint C80 and 20 parts carnauba wax was melt dispersed in water, with Akypo™ RLM100 (Kao). The total solids was 25.09%.

EXAMPLE 4

Wet-cake of Carboxy Functional Compound

EXAMPLE 4.1

Wet-cake of Carboxy Functional Compound (d-1)

A wet-cake (d-1) of BONTRON E88™ in water (ex Orient) was used, which had a solids (BONTRON E88) content of 21.4%. BONTRON E88 is an aluminium complex of an alkyl salicylic acid compound (i.e. a carboxy functional compound of Formula (1)).

EXAMPLE 5

Toner Preparation

EXAMPLE 5.1

Toner 1 (Comparative)

Mixing Step:

Latex (a-1) (610.39), Latex (a-4) (70.4 g), the pigment dispersion (b-3) (36.5 g), wax dispersion (c-2) (118.8 g) and water (1415 g) were mixed and stirred.

Association and Particle Growth:

The temperature of the mixture was raised to 37° C. Over the course of 290 seconds the mixed dispersions were circulated through a high shear mixer and back into the vessel during which 4% sulphuric acid (250 g) was added into the high shear mixer. The pH had reduced to 1.7. The mixture was heated for the next 155 minutes (to a maximum temperature of 58.1° C.). The mixture was then cooled to 50° C. A solution of sodium hydroxide 0.5M was added over 14 minutes to raise the pH to 7.

Coalescence Step:

The temperature of the mixture was then raised to 120° C. and held at this temperature for a total of 60 minutes with stirring before being cooled to room temperature. Coulter Counter™ analysis showed the mean volume particle size was 7.2 μm, the GSDv was 1.31 and the GSDn was 1.41. Microscopic analysis showed the toner particles to be of uniform size and slightly irregular in shape.

EXAMPLE 5.2

Toner 2 (Comparative)

Mixing Step:

Latex (a-1) (783.9 g), Latex (a-3) (90.4 g), the pigment dispersion (b-1) (47.8 g), wax dispersion (c-1) (153.7 g), wet-cake (d-1) (15.5 g) and water (1128.9 g) were mixed and stirred. The total content of the carboxy functional compound (BONTRON E88) was 1% based on the total weight of the compound and the solids content of the latex, pigment and wax dispersions.

Association and Particle Growth:

The temperature of the mixture was raised to 37° C. Over the course of 270 seconds the mixture was circulated through a high shear mixer and back into the vessel during which 4% sulphuric acid (280 g) was added into the high shear mixer. The pH was reduced to 1.85 by the addition of the acid. The mixture was heated for the next 175 minutes to a maximum temperature of 55.4° C. The mixture was then cooled to 50° C. A solution of sodium hydroxide (0.5M) was added over 13 minutes to raise the pH to 7.

Coalescence Step:

The temperature of the mixture was then raised to 120° C. and the mixture was held at this temperature for a total of 60 minutes with stirring before being cooled to room temperature. Using a 100 μm aperture, Coulter Counter™ analysis of the toner particles in the dispersion showed the mean volume particle size was 6.1 μm, the GSDv was 1.25 and the GSDn was 1.39. Microscopic analysis showed the toner particles to be of uniform size and slightly irregular in shape.

EXAMPLE 5.3

Toner 3

Mixing Step:

Latex (a-1) (976.5 g), Latex (a-5) (112.7 g), the pigment dispersion (b-1) (58.8 g), wax dispersion (c-3) (191.4 g) and water (807.1 g) were mixed and stirred.

In a separate bottle 2-hydroxy-3-naphthoic acid (6.00 g) was dissolved in a 67.71 g of sodium hydroxide (0.5M). The resultant solution was then added to the latex, pigment and wax mixture. Thus, the total content of carboxy functional compound (2-hydroxy-3-naphthoic acid in sodium salt form) was 1.5% based on the total weight of carboxy functional compound and the solids content of the latex, pigment and wax dispersions.

Association and Particle Growth:

The temperature of the mixture was raised to 37° C. Over the course of 305 seconds the mixed dispersions were circulated through a high shear mixer and back into the vessel during which 4% sulphuric acid (280 g) was added into the high shear mixer. The pH had reduced to 2. The mixture was heated for the next 175 minutes (to a maximum temperature of 56.3° C.). The mixture was then cooled to 50° C. A solution of sodium hydroxide 0.5M was added over 10 minutes to raise the pH to 7.

Coalescence Step:

The temperature of the mixture was then raised to 120° C. and held at this temperature for a total of 60 minutes with stirring before being cooled to room temperature. Coulter Counter™ analysis showed the mean volume particle size was 5.8 μm, the GSDv was 1.31 and the GSDn was 1.28. Microscopic analysis showed the toner particles to be of uniform size and slightly irregular in shape.

EXAMPLE 5.4

Toner 4

Mixing Step:

Latex (a-1) (964.9 g), Latex (a-3) (111.3 g), the pigment dispersion (b-1) (58.8 g), wax dispersion (c-1) (189.1 g), wet-cake (d-1) (18.7 g), Akypo™ RLM 100 (20 g, 40% solids) and water (758.99) were mixed and stirred.

In a separate bottle, a further carboxy functional compound, 2-hydroxy-3-naphthoic acid (8.00 g), was dissolved in 90.28 g of sodium hydroxide (0.5M). The resultant solution was then added to the latex, pigment, wax, BONTRON E88 mixture. The total content of carboxy functional compound was 2.9% (1% BONTRON E88 and 1.9% 2-hydroxy-3-naphthoic acid) based on the total weight of carboxy functional compound, the solids content of the latex, pigment and wax dispersions and the added Akypo surfactant.

Association and Particle Growth:

The temperature of the mixture was raised to 37° C. Over the course of 295 seconds the mixture was circulated through a high shear mixer and back into the vessel during which 4% sulphuric acid (280 g) was added into the high shear mixer. The pH was reduced to 2.27 by the addition of the acid. The mixture was heated for the next 222 minutes to a maximum temperature of 57.0° C. The mixture was then cooled to 50° C. A solution of sodium hydroxide (0.5M) was added over 20 minutes to raise the pH to 7.

Coalescence Step:

The temperature of the mixture was then raised to 120° C. and held at this temperature for a total of 60 minutes with stirring before being cooled to room temperature. Coulter Counter™ analysis of the toner particles in the dispersion showed the mean volume particle size was 5.4 μm, the GSDv was 1.23 and the GSDn was 1.25. Microscopic analysis showed the toner particles to be of uniform size and slightly irregular in shape.

EXAMPLE 5.5

Toner 5

Mixing Step:

Latex (a-1) (965 g), Latex (a-3) (111.3 g), the pigment dispersion (b-1) (58.8 g), wax dispersion (c-1) (189.2 g), wet-cake (d-1) (18.7 g), Akypo™ RLM 100 (11 g, 40% solids) and water (770 g) were mixed and stirred.

In a separate bottle 2-hydroxy-3-naphthoic acid (8.00 g) was dissolved in 90.28 g of sodium hydroxide (0.5M). The resultant solution was then added to the latex, pigment, wax, BONTRON E88 mixture. Thus, the total content of carboxy functional compound was 2.9% (1% BONTRON E88 and 1.9% 2-hydroxy-3-naphthoic acid) based on the total weight of carboxy functional compound, the solids content of the latex, pigment and wax dispersions and the added Akypo™ surfactant.

Association and Particle Growth:

The temperature of the mixture was raised to 37° C. Over the course of 280 seconds the mixture was circulated through a high shear mixer and back into the vessel during which 4% sulphuric acid (280 g) was added into the high shear mixer. The pH was reduced to 2.15 by the addition of acid. The mixture was heated for the next 178 minutes to a maximum temperature of 57.0° C. The mixture was then cooled to 50° C. A solution of sodium hydroxide (0.5M) was added over 12 minutes to raise the pH to 7.

Coalescence Step:

The temperature of the mixture was then raised to 120° C. and held at this temperature for a total of 60 minutes with stirring before being cooled to room temperature. Coulter Counter™ analysis of the toner particles showed the mean volume particle size was 6.1 μm, the GSDv was 1.21 and the GSDn was 1.23. Microscopic analysis showed the toner particles to be of uniform size and slightly irregular in shape.

EXAMPLE 5.6

Toner 6

Mixing Step:

Latex (a-1) (976.6 g), Latex (a-4) (112.7 g), the pigment dispersion (b-3) (58.33 g), wax dispersion (c-2) (190.1 g), Akypo RLM 100 (20 g, 40% solids) and water (698.8 g) were mixed and stirred.

In a separate bottle 2-hydroxy-3-naphthoic acid (13.32 g) was dissolved in a 150.32 g of sodium hydroxide (0.5M). The resultant solution was then added to the latex, pigment and wax mixture. Thus, the total content of carboxy functional compound (2-hydroxy-3-naphthoic acid salt) was 3.1% based on the total weight of carboxy functional compound, the solids content of the latex, pigment and wax dispersions and the added surfactant (Akypo™ RLM 100).

Association and Particle Growth:

The temperature of the mixture was raised to 37° C. Over the course of 290 seconds the mixed dispersions were circulated through a high shear mixer and back into the vessel during which 4% sulphuric acid (280 g) was added into the high shear mixer. The pH had reduced to 2.1. The mixture was heated for the next 175 minutes (to a maximum temperature of 58.1° C.). The mixture was then cooled to 50° C. A solution of sodium hydroxide 0.5M was added over 16 minutes to raise the pH to 7.

Coalescence Step:

The temperature of the mixture was then raised to 120° C. and held at this temperature for a total of 60 minutes with stirring before being cooled to room temperature. Coulter Counter™ analysis showed the mean volume particle size was 7.0 μm, the GSDv was 1.24 and the GSDn was 1.23. Microscopic analysis showed the toner particles to be of uniform size and slightly irregular in shape.

EXAMPLE 5.7

Toner 7

Mixing Step:

Latex (a-1) (976.4 g), Latex (a-4) (112.7 g), the pigment dispersion (b-2) (58.4 g), wax dispersion (c-2) (190.1 g), Akypo RLM 100 (20 g, 40% solids) and water (735.0 g) were mixed and stirred.

In a separate bottle 3,5-di-tertbutylsalicylic acid (13.32 g) was dissolved in a 113.54 g of sodium hydroxide (0.5M). The resultant solution was then added to the latex, pigment and wax mixture. Thus, the total content of carboxy functional compound (3,5-di-tertbutylsalicylic acid salt) was 3.1% based on the total weight of carboxy functional compound, the solids content of the latex, pigment and wax dispersions and the added surfactant (Akypo™ RLM 100).

Association and Particle Growth:

The temperature of the mixture was raised to 37° C. Over the course of 290 seconds the mixed dispersions were circulated through a high shear mixer and back into the vessel during which 4% sulphuric acid (280 g) was added into the high shear mixer. The pH had reduced to 1.9. The mixture was heated for the next 175 minutes (to a maximum temperature of 58.0° C.). The mixture was then cooled to 50° C. A solution of sodium hydroxide 0.5M was added over 15 minutes to raise the pH to 7.

Coalescence Step:

The temperature of the mixture was then raised to 120° C. and held at this temperature for a total of 60 minutes with stirring before being cooled to room temperature. Coulter Counter™ analysis showed the mean volume particle size was 5.9 μm, the GSDv was 1.24 and the GSDn was 1.23. Microscopic analysis showed the toner particles to be of uniform size and slightly irregular in shape.

EXAMPLE 5.8

Toner 8

Mixing Step:

Latex (a-1) (976.4 g), Latex (a-3) (112.7 g), the pigment dispersion (b-3) (58.4 g), wax dispersion (c-2) (190.1 g) and water (718.8 g) were mixed and stirred.

In a separate bottle 2-hydroxy-3-naphthoic acid (13.32) was dissolved in a 150.32 g of sodium hydroxide (0.5M). The resultant solution was then added to the latex, pigment and wax mixture. Thus, the total content of carboxy functional compound (2-hydroxy-3-naphthoic acid salt) was 3.2% based on the total weight of carboxy functional compound and the solids content of the latex, pigment and wax dispersions added.

Association and Particle Growth:

The temperature of the mixture was raised to 37° C. Over the course of 300 seconds the mixed dispersions were circulated through a high shear mixer and back into the vessel during which 4% sulphuric acid (280 g) was added into the high shear mixer. The pH had reduced to 2.24. The mixture was heated for the next 175 minutes (experiencing a maximum temperature of 57.1° C.). The mixture was then cooled to 50° C.

A solution of sodium hydroxide 0.5M was added over 12 minutes to raise the pH to 7.

Coalescence Step:

The temperature of the mixture was then raised to 120° C. and held at this temperature for a total of 60 minutes with stirring before being cooled to room temperature. Coulter Counter™ analysis showed the mean volume particle size was 8.1 μm, the GSDv was 1.29 and the GSDn was 1.27.

Association and Particle Growth:

The temperature of the mixture was raised to 37° C. Over the course of 290 seconds the mixed dispersions were circulated through a high shear mixer and back into the vessel during which 4% sulphuric acid (280 g) was added into the high shear mixer. The pH had reduced to 2.26. The mixture was heated for the next 155 minutes (to a maximum temperature of 58° C.). The mixture was then cooled to 50° C. A solution of sodium hydroxide 0.5M was added over 13 minutes to raise the pH to 7.

Coalescence Step:

The temperature of the mixture was then raised to 120° C. and held at this temperature for a total of 60 minutes with stirring before being cooled to room temperature. Coulter Counter™ analysis showed the mean volume particle size was 8.0 μm, the GSDv was 1.22 and the GSDn was 1.29. Microscopic analysis showed the toner particles to be of uniform size and slightly irregular in shape.

The particle sizes and particle size distributions of the toners are shown in Table 1. It can be seen that the particle size distribution, as characterised by the GSDn and GSDv value, especially GSDn is significantly narrower for the Toners made according to the present invention compared to the comparative Toners 1 and 2.

TABLE 1

| Example | % wt. Carboxy Functional Compound (acid or salt form) | % wt Carboxy Functional Compound (complex form) | % wt Carboxy Functional Compound (total) | Mean Volume Particle size (μm) | GSDv | GSDn |
|---|---|---|---|---|---|---|
| Toner 1 (Comparative) | 0 | 0 | 0 | 7.2 | 1.31 | 1.41 |
| Toner 2 (Comparative) | 0 | 1.0 | 1.0 | 6.1 | 1.25 | 1.39 |
| Toner 3 | 1.5 | 0 | 1.5 | 5.8 | 1.31 | 1.28 |
| Toner 4 | 1.9 | 1.0 | 2.9 | 5.4 | 1.23 | 1.25 |
| Toner 5 | 1.9 | 1.0 | 2.9 | 6.1 | 1.21 | 1.23 |
| Toner 6 | 3.1 | 0 | 3.1 | 7.0 | 1.24 | 1.23 |
| Toner 7 | 3.1 | 0 | 3.1 | 5.9 | 1.24 | 1.23 |
| Toner 8 | 3.2 | 0 | 3.2 | 8.1 | 1.29 | 1.27 |
| Toner 9 | 3.2 | 1.0 | 4.2 | 8.0 | 1.22 | 1.29 |

Microscopic analysis showed the toner particles to be of uniform size and slightly irregular in shape.

EXAMPLE 5.9

Toner 9

Mixing Step:

Latex (a-1) (964.9 g), Latex (a-4) (111.4 g), the pigment dispersion (b-3) (58.33 g), wax dispersion (c-2) (190.1 g), wet-cake (d-1) (18.7 g) and water (680) were mixed and stirred.

In a separate bottle 2-naphthoic acid (13.32 g) was dissolved in a 164.29 g of sodium hydroxide (0.5M). The resultant solution was then added to the latex, pigment, wax and wet cake mixture. Thus, the total content of carboxy functional compound was 4.2% (comprising 1% Bontron™ E88 complex from the wet cake and 3.2% 2-naphthoic acid salt) based on the total weight of carboxy functional compound and the solids content of the latex, pigment and wax dispersions.

The invention claimed is:

1. A process for the manufacture of a toner which comprises the steps of:

a) providing a latex dispersion containing primary resin particles and surfactant;

b) providing a colorant dispersion containing primary colorant particles and surfactant;

c) optionally providing a wax dispersion containing primary wax particles and surfactant;

d) providing at least one carboxy functional compound of Formula (1), which may be in acid, salt and/or complex form:

Formula (1)

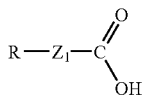

wherein

R is a carbocyclic or heterocyclic radical which may be optionally substituted and $Z_1$ is a bond or linker group, on condition that the amount of carboxy functional compound of Formula (1) provided in acid and/or salt form is at least 1.5% by weight, wherein the amount of carboxy functional compound is calculated according to the following equation:

amount of carboxy functional compound content (% weight)=100×weight of carboxy functional compound/ (weight of carboxy functional compound+weight of solids of latex, colorant and optional wax dispersions+weight of any additional surfactant)

e) mixing the latex dispersion, colorant dispersion, optional wax dispersion and said carboxy functional compound; and f) causing the particles in the mixture to associate.

2. A process as claimed in claim 1 wherein R is selected from the group consisting of optionally substituted phenyl and optionally substituted naphthyl.

3. A process as claimed in claim 1 or 2 wherein the carboxy functional compound, which may be in acid, salt and/or complex form, has a Formula (2):

Formula (2)

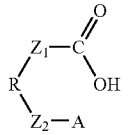

where $Z_2$ is a bond or linker group and A is an ionisable group.

4. A process as claimed in claim 3 wherein A is OH.

5. A process as claimed in claim 1 wherein the carboxy functional compound which may be in acid, salt and/or complex form is selected from the group consisting of: salicylic acid; substituted salicylic acid; hydroxy naphthoic acid; and substituted hydroxy naphthoic acid.

6. A process as claimed in claim 1 wherein there is provided a mixture of two or more carboxy functional compounds of Formula (1) in step (d).

7. A process as claimed in claim 1 wherein the amount of carboxy functional compound of Formula (1) provided in acid and/or salt form is at least 2.0% by weight.

8. A process as claimed in claim 7 wherein the amount of carboxy functional compound of Formula (1) provided in acid and/or salt form is greater than 3.0% by weight.

9. A process as claimed in claim 1 wherein a portion of the carboxy functional compound is provided in complex form in an amount of at least 1% by weight.

10. A process as claimed in claim 1 wherein the amount of the carboxy functional compound provided is not more than 7% by weight.

11. A process as claimed in claim 10 wherein the amount of carboxy functional compound is not more than 5% by weight.

12. A process as claimed in claim 1 wherein the mixture is caused to associate in step (f) by adjusting the pH.

13. A process as claimed in claim 1 wherein after the association in step (f) the process comprises a further step (g) of heating and/or stirring the associated mixture.

14. A process as claimed in claim 1 wherein after the association in step (f) and the optional further step (g) of heating and/or stirring the associated mixture, the process comprises a further step (h) which comprises raising the temperature above the Tg of the resin to bring about coalescence of the particles.

15. A process as claimed in claim 1 wherein the volume average particle size of the toner is in the range from 2 to 20 μm and the $GSD_n$ value is not greater than 1.30.

16. A process as claimed in claim 15 wherein the $GSD_n$ value is not greater than 1.28.

17. A process as claimed in claim 16 wherein the $GSD_n$ value is not greater than 1.25.

18. A process as claimed in claim 1 wherein the carboxy functional compound of Formula (1) is optionally substituted naphthoic acid or a salt or a complex thereof.

* * * * *